US007832219B2

(12) United States Patent
Baranowski et al.

(10) Patent No.: US 7,832,219 B2
(45) Date of Patent: Nov. 16, 2010

(54) ICE MAKING MACHINE AND METHOD

(75) Inventors: Philip J. Baranowski, Mishicot, WI (US); Lee G. Mueller, Kewaunee, WI (US); John P. Myers, Manitowoc, WI (US); Curt R. Cayemberg, Manitowoc, WI (US); Brian A Ebelt, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 409 days.

(21) Appl. No.: 11/647,821

(22) Filed: Dec. 29, 2006

(65) Prior Publication Data

US 2008/0156019 A1 Jul. 3, 2008

(51) Int. Cl.
*F25C 1/12* (2006.01)

(52) U.S. Cl. ..... 62/74; 62/347; 62/352

(58) Field of Classification Search ..... 62/347, 62/352, 74

See application file for complete search history.

(56) References Cited

U.S. PATENT DOCUMENTS

| | | | | |
|---|---|---|---|---|
| 2,937,508 | A | 5/1960 | Garland | |
| 3,423,952 | A | 1/1969 | Pugh | |
| 3,430,452 | A | 3/1969 | Dedricks et al. | |
| 4,365,485 | A | 12/1982 | Samuelsen | |
| 4,480,441 | A | 11/1984 | Schulze-Berge et al. | |
| 4,489,567 | A | 12/1984 | Kohl | |
| 4,550,572 | A | 11/1985 | Schulze-Berge | |
| 4,767,286 | A | 8/1988 | Kohl et al. | |
| 4,774,815 | A | 10/1988 | Schlosser | |
| 4,785,641 | A | 11/1988 | McDougal | |
| 4,938,030 | A | 7/1990 | Josten et al. | |
| 4,986,088 | A * | 1/1991 | Nelson | 62/347 |
| 5,031,417 | A * | 7/1991 | Chang | 62/347 |
| 5,197,357 | A | 3/1993 | Cote | |
| 5,408,834 | A | 4/1995 | Schlosser et al. | |
| 5,924,301 | A | 7/1999 | Cook | |
| 6,058,731 | A | 5/2000 | Byczynski et al. | |
| 6,062,036 | A | 5/2000 | Hobelsberger | |

(Continued)

OTHER PUBLICATIONS

Manitowoc Equipment Works, C-0200 & C-0400 Series Ice Cuber Service Manual, published prior to Dec. 28, 2005, Manitowoc, WI.

(Continued)

*Primary Examiner*—William E Tapolcai
(74) *Attorney, Agent, or Firm*—Michael Best & Friedrich LLP

(57) ABSTRACT

An ice barrier and an ice making machine having an ice barrier is provided in some embodiments, wherein the ice barrier is movable between a first orientation in which liquid water from an ice-forming surface is directed into the liquid receptacle, and a second orientation in which the ice barrier blocks access of ice from the ice-forming surface to locations in which ice is trapped between the ice barrier and an adjacent surface. Also, a method of producing ice in an ice making machine is provided in some embodiments, wherein a barrier diverts a flow of liquid water received from the ice-forming surface away from an ice collection bin, and wherein the barrier is moved to an orientation in which the barrier diverts ice toward the ice collection bin and also blocks access of ice to positions trapped between the barrier and an adjacent surface.

31 Claims, 4 Drawing Sheets

U.S. PATENT DOCUMENTS

| | | | |
|---|---|---|---|
| 6,209,340 | B1 | 4/2001 | Lu |
| 6,907,744 | B2 | 6/2005 | Miller et al. |
| 6,993,929 | B1 | 2/2006 | Funk et al. |
| 7,032,406 | B2 | 4/2006 | Hollen et al. |
| 2001/0054295 | A1 | 12/2001 | Kawasumi et al. |

OTHER PUBLICATIONS

Manitowoc Equipment Works, C-0600 Series Ice Cuber Service Manual, Jan. 12, 1980, Manitowoc, WI.

Manitowoc, Ice Machine Parts List for Series Q130 Models, published prior to Dec. 28, 2005, p. 3, Manitowoc, WI.

Manitowoc, Ice Machine Parts List for Series Q210 Models, published prior to Dec. 28, 2005, p. 3, Manitowoc, WI.

Manitowoc, Ice Machine Parts List for Series Models CR0200A, CR0201W, CD0202A, CD0203W, Cy0204A and CY0205W, published prior to Dec. 28,2005, p. 2, Manitowoc, WI.

* cited by examiner

ICE MAKING MACHINE AND METHOD

BACKGROUND

Many automated ice making machines have moving parts used to direct water and ice moving within the ice making machine. In many cases, these moving parts can become jammed by ice trapped by and/or within such moving parts. Resulting service calls for clearing jammed parts of trapped ice lead to unnecessary expense and maintenance of ice making machines. Also, one or more sensors often used to control operation of ice making machines based upon the position of a movable ice making machine part can produce false signals or can fail to produce necessary signals for proper machine operation. As a result, ice making machines can produce too much ice, can stop producing ice prematurely, or can malfunction in other manners. Clearly, in light of these and other problems and issues arising with respect to existing ice making machines, new ice making machines and methods would be welcome in the art.

SUMMARY

Some embodiments of the present invention provide an ice making apparatus comprising an ice-forming surface with a plurality of ice-forming locations for forming ice cubes as liquid water is run across the ice-forming surface; an ice collection bin positioned at a lower elevation than the ice-forming surface; a liquid receptacle at a lower elevation than the ice-forming surface and positioned to collect liquid water from the ice-forming surface; and an ice barrier adjacent the liquid receptacle, the ice barrier movable between a first orientation in which liquid water from the ice-forming surface is directed into the liquid receptacle, and a second orientation in which the ice barrier blocks access of ice from the ice-forming surface to locations in which the ice is trapped between the ice barrier and an adjacent surface.

In some embodiment, the present invention provides a barrier movable between a first orientation and a second orientation within an ice making apparatus having an ice collection bin, the barrier comprising a first surface for directing ice into the ice collection bin when the barrier is in the first orientation, and for directing liquid water away from the ice collection bin when the barrier is in the second orientation; and a second surface positioned with respect to the first surface to block movement of ice produced by the ice making apparatus into a trapped position between the barrier and another portion of the ice making apparatus when the barrier is in the first orientation.

Some embodiments of the present invention provide a method of producing ice in an ice making machine, the method comprising running liquid water over an ice-forming surface; chilling the ice-forming surface to freeze at least a portion of the liquid water running over the ice-forming surface; orienting a barrier in a first orientation; diverting a flow of liquid water received from the ice-forming surface with the barrier away from an ice collection bin in which ice produced by the ice making machine is collected; moving the barrier to a second orientation; and directing ice received from the ice-forming surface toward the ice collection bin with the barrier in the second orientation while also blocking access of ice to positions trapped between the barrier and an adjacent surface with the barrier in the second orientation.

Other aspects of the invention will become apparent by consideration of the detailed description and accompanying drawings.

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
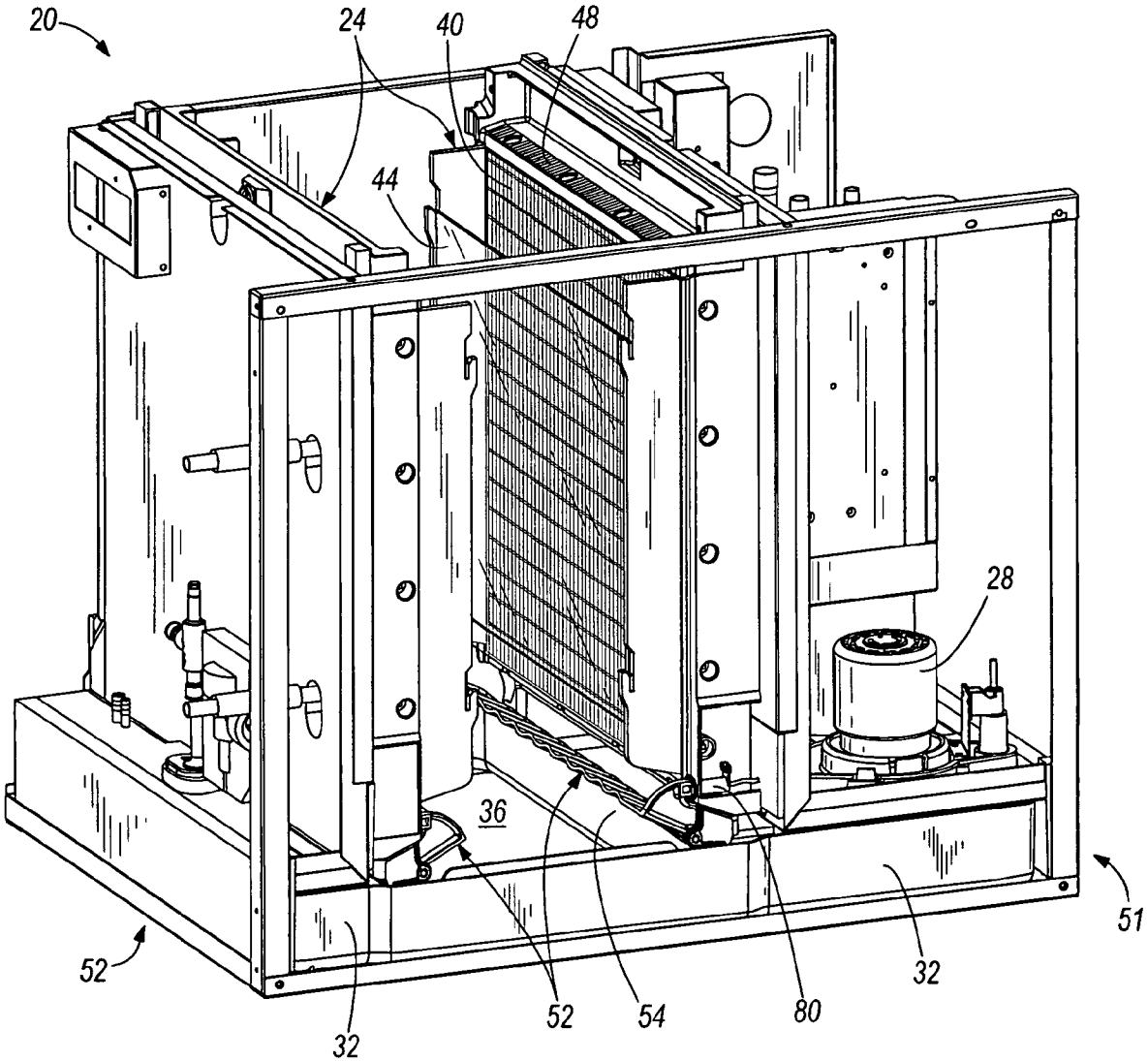
FIG. 1 is a perspective view of an ice making machine according to an embodiment of the present invention.

An ice making machine 20 according to an embodiment of the present invention is shown in FIG. 1, and includes a pair of evaporator assemblies 24, a water pump 28, a water sump 32, and an ice chute 36 through which ice pieces 38 are discharged to a bin (not shown) for collection and storage. Although the ice making machine 20 illustrated in FIG. 1 is adapted for forming unconnected pillow-shaped pieces of ice, it should be noted that the various aspects of the present invention can be applied to ice machines adapted to produce ice in any other shape (e.g., cubes) formed in unconnected or connected assemblies on any type of ice forming surface (e.g., individual pockets or other receptacles, one or more troughs, a flat or substantially flat ice forming sheet, and the like). With reference again to the embodiment of FIG. 1, each evaporator assembly 24 of the illustrated ice making machine 20 includes an ice-forming surface 40.

Each evaporator assembly 24 in the illustrated embodiment has a shield 44 adjacent the ice-forming surface 40. Although not required, the shield 44 can be used to control the discharge of ice from the ice-forming surface 40 during a harvesting cycle of the ice making machine 20. The ice-forming surface 40 and the shield 44 are oriented substantially vertically and are spaced a relatively small distance apart, although it will be appreciated that the ice-forming surface 40 and/or the shield 44 can be oriented in other manners while still performing their respective functions.

In some embodiments, a flexible curtain 46 can be attached to the shield 44 and can extend from a bottom portion of the shield. For example, each evaporator assembly 24 in the illustrated embodiment has a flexible curtain 46 attached to the shield 44. The flexible curtain 46 is angled or curved toward the ice-forming surface 40 in an at-rest state, but is pliable and easily deflected outwardly away from the ice-forming surface 40 when contacted by ice pieces 38. In other embodiments, the flexible curtain can have other shapes also capable of being deflected when contacted by ice falling from the ice-forming surface 40.

Figure 2:
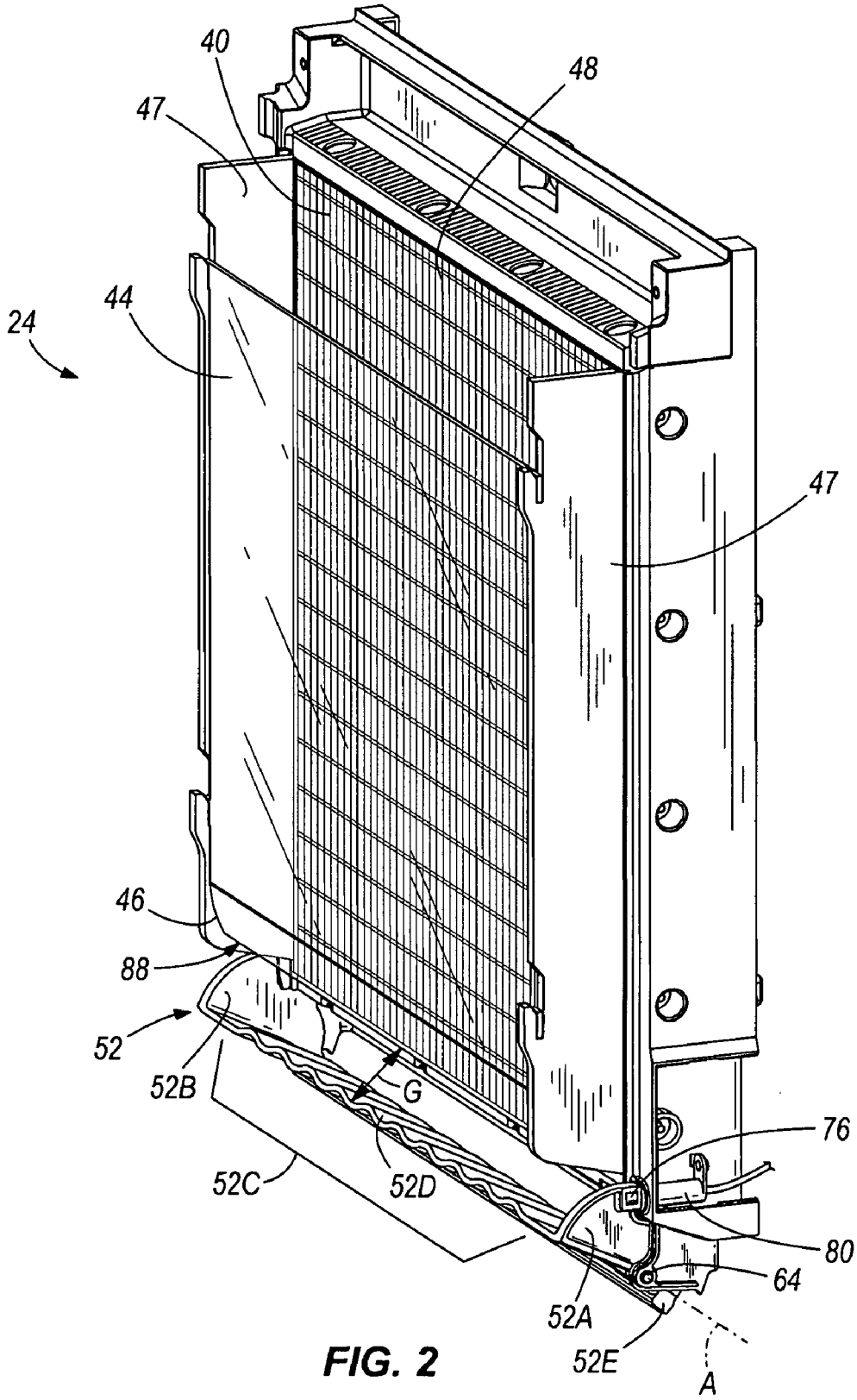
FIG. 2 is a perspective view of an evaporator assembly of the ice making machine of FIG. 1, shown with the ice barrier of the ice making machine in a first orientation.
Figure 3:
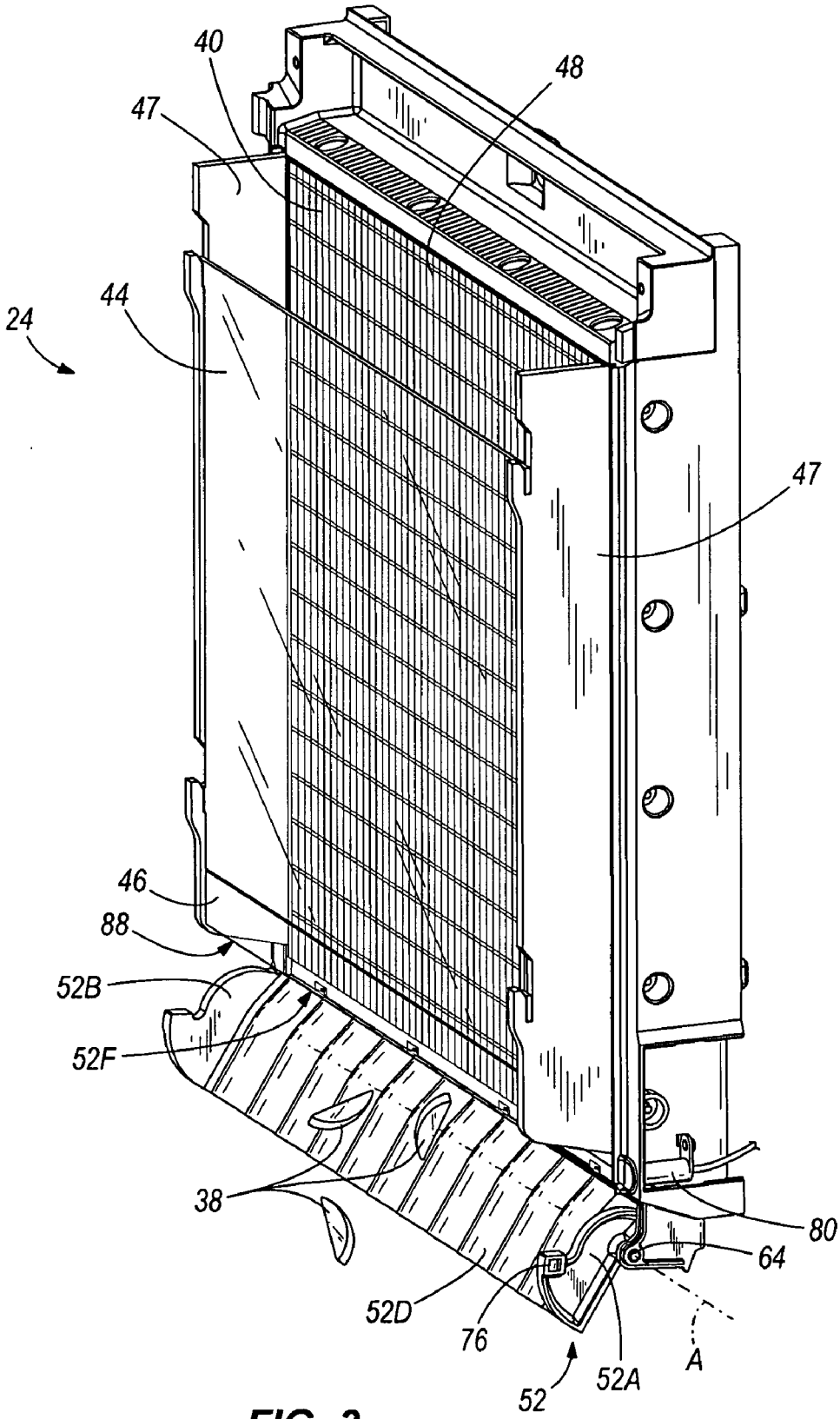
FIG. 3 is a perspective view of the evaporator assembly of FIG. 2, shown with the ice barrier in a second orientation.

With continued reference to the illustrated embodiment, the shield 44 of each evaporator assembly 24 is supported by side panels 47 of the evaporator assembly 24 (see FIGS. 2 and 3). In particular, the shield 44 has projections that mate with apertures in the side panels 47 of the evaporator assembly 24. The shield 44 can be removable without the use of tools, such as by lifting the shield 44 from its position shown in FIGS. 1-3. In other embodiments, the shield 44 can be removably attached to the side panels 47 of each evaporator assembly in other manners, such as by projections of the side panels 47 removably received within apertures in the shield 44, by pin and aperture connections, by other inter-engaging element connections, or in any other suitable manner.

An evaporator 48 is connected to each ice-forming surface 40 of the illustrated ice making machine 20 in order to chill the ice-forming surfaces 40. The evaporators 48 are part of a refrigeration system, which circulates a refrigerant through a refrigeration cycle to chill each ice-forming surface 40.

As shown in FIG. 1, the ice chute 36 is positioned between the evaporator assemblies 24 to receive ice pieces 38 therefrom. One evaporator assembly 24 is positioned adjacent the water pump 28 (near a first end 51 of the ice making machine 20), and the other evaporator assembly 24 is substantially remote from the water pump 28 (near a second end 52 of the ice making machine 20). The water sump 32 includes portions adjacent the first and second ends 51 and 52 of the ice making machine 20 to receive water from the adjacent evaporator assemblies 24 as described in further detail below. The water sump 32 extends around both sides of the ice chute 36 such that the portion of the water sump 32 adjacent the second end 52 of the ice making machine 20 is in communication with the portion of the water sump 32 adjacent the first end 51. The water pump 28 is in fluid communication with the water sump 32 at the first end 51 of the ice making machine 20. In other embodiments, water can be received within a water sump 32 having any other shape and size desired, such as a pan located generally beneath one or more evaporator assemblies 24, one or more troughs positioned to receive water from one or more evaporator assemblies 24, and the like.

Unless otherwise noted, the description of the evaporator assembly 24 (and its components) herein applies to both evaporator assemblies 24, which are substantially identical in structure and operation in the illustrated embodiment. Any number of evaporator assemblies 24 can be provided as part of the ice making machine 20, such as one, three, or more evaporator assemblies 24. FIGS. 2 and 3 illustrate a single evaporator assembly 24 with the rest of the ice making machine 20 omitted for clarity.

As shown in FIG. 1, an ice barrier 52 is positioned at the bottom of the evaporator assembly 24 along a boundary wall 54 separating the water sump 32 and the ice chute 36. The ice barrier 52 of the illustrated embodiment is positioned vertically above the water sump 32 and the ice chute 36, but substantially below the ice-forming surface 40. The ice barrier 52 is rotatably mounted, and is movable about a pivot axis A between a first orientation (shown in FIG. 2) and a second orientation (shown in FIG. 3). In some embodiments, the ice barrier 52 is rotatably mounted to the evaporator assembly 24, while in others the ice barrier 52 is also or instead rotatably mounted to other structure of the ice making machine 20.

In the first orientation shown in FIG. 2, the ice barrier 52 allows fluid communication between the ice-forming surface 40 and the water sump 32. Unfrozen water flowing from the ice forming surface 40 is directed by the ice barrier 52 toward the water sump 32 in the first orientation of the ice barrier 52. In the second orientation, the ice barrier 52 directs ice pieces 38 from the ice-forming surface 40 to the ice chute 36 and substantially blocks off the path of ice to the water sump 32.

Figure 4:
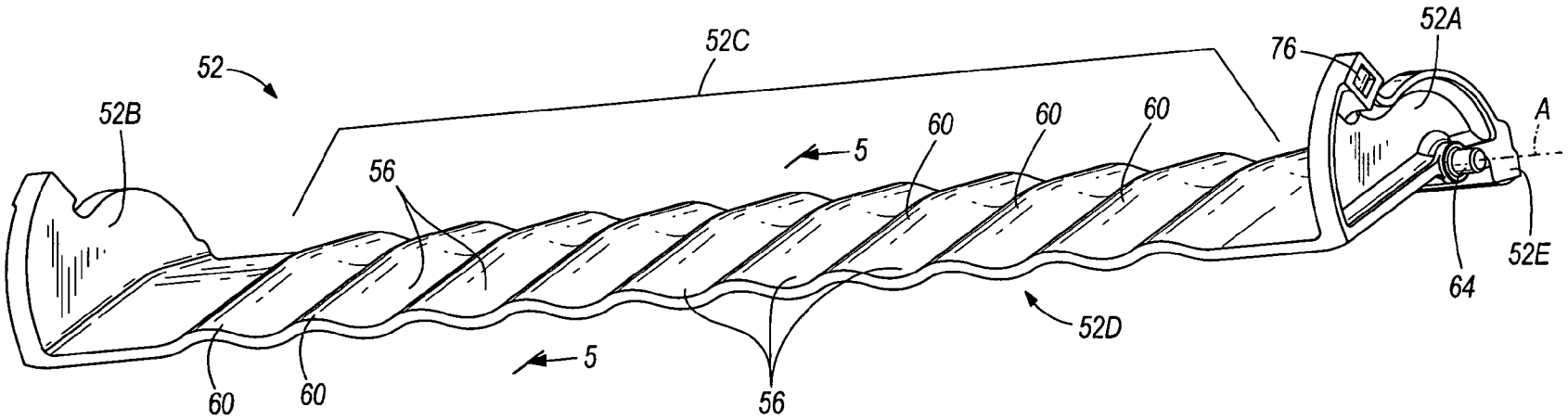
FIG. 4 is a perspective view of the ice barrier of FIGS. 1-3.
Figure 5:
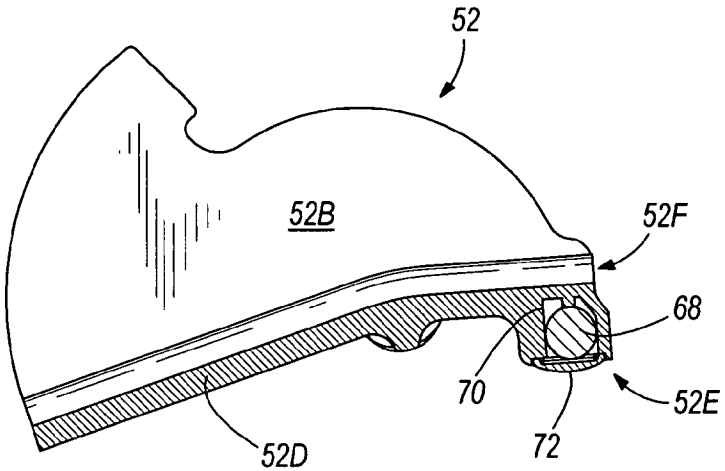
FIG. 5 is a cross-sectional view of the ice barrier of FIGS. 1-3, taken along line 5-5 of FIG. 4.

Shown in detail in FIGS. 4 and 5, the illustrated ice barrier 52 includes first and second end portions 52A and 52B and a first portion 52C extending between the first and second end portions 52A and 52B. The ice barrier 52 also includes a convoluted portion 52D and a counterweight portion 52E. The convoluted portion 52D meets the counterweight portion 52E at a second portion 52F of the ice barrier 52. The convoluted portion 52D is formed to include a series of channels 56 spaced apart by a series of ridges 60, and can be defined by a convoluted or corrugated shape. The channels 56 are concave to collect and direct water along the ice barrier 52 (substantially perpendicular to the pivot axis A) and into the water sump 32 in the first orientation of the ice barrier 52 described above. Each ridge 60 is convex to direct water into the adjacent channel(s) 56. Water incident on the ice barrier 52 when in the first orientation shown in FIG. 2 is directed toward the water sump 32 along a series of defined flow paths (i.e., the channels 56). Although the semi-circular or rounded channels 56 and ridges 60 of the convoluted portion 52D have been found to perform in a superior manner in many cases, alternate profile shapes are considered, such as a V-shape for the channels 56 and/or ridges 60. In still other embodiments, the first portion 52C of the ice barrier 52 can be provided with ribs, bumps, or other protuberances, and/or grooves, holes, dimples or other recesses for directing water into a series of defined flow paths. Alternatively, the first portion 52C can be substantially flat with no such features.

Referring still to FIGS. 4 and 5, the counterweight portion 52E of the ice barrier 52 includes a counterweight 68. The counterweight 68 can take any shape, and can be defined by a single element or multiple elements. In the illustrated embodiment, for example, the counterweight 68 is substantially cylindrical. The counterweight 68 in the illustrated embodiment is positioned within a receiving channel 70, which is covered by a cover 72 secured to the open end of the receiving channel 70. In some embodiments, the cover 72 retains the counterweight 68 and/or seals off the receiving channel 70 from water within the ice making machine 20. In other embodiments, the counterweight 68 can be integrally formed with the ice barrier 52 (e.g., molded or cast into the material of the ice barrier 52), can be slidably received in an elongated aperture at an end 52A and/or 52B of the ice barrier 52, or can be attached to the ice barrier 52 in any other manner. The counterweight 68 has a position and weight, which act to bias the ice barrier 52 toward the first orientation, but to allow the ice barrier 52 to be pivoted toward the second orientation when ice pieces 38 fall onto the first portion 52C. The biasing force (toward the first orientation) is affected by the material properties of the ice barrier 52 and the counterweight 68, the location of the counterweight 68 with respect to the pivot axis A, and the shape and size of the ice barrier 52 relative to the pivot axis A.

Although a counterweight 68 is used in the illustrated embodiment to bias the ice barrier 52 toward the first orientation illustrated in FIG. 2, other devices can be used to perform this function. For example, the ice barrier 52 can be biased by one or more springs (including without limitation torsion springs, coil spring, elastic bands, and the like), magnets, actuators (e.g., solenoids), drives connected to an axle at the pivot axis A or to suitable gearing connected to the ice barrier 52, and the like.

The ice barrier 52 includes two pivot pins 64 (one at each of the end portions 52A and 52B) which are received into the side panels 47 of the evaporator assembly 24. Alternatively, pivot pins on the side panels 47 or other portion of the ice making machine 20 can be received within apertures in the ice barrier 52. In this manner, the ice barrier 52 is capable of pivoting about the axis A.

With reference now to FIG. 4 of the illustrated embodiment, a magnet 76 is carried with the ice barrier 52 at its first end portion 52A. The magnet 76 is positioned on the ice barrier 52 so that it is in close proximity to a switch 80 on the side panel 47 adjacent the first end portion 52A when the ice barrier 52 is in the first orientation (see FIGS. 2 and 3). When the ice barrier 52 is pivoted substantially away from the first orientation (i.e., toward the second orientation of FIG. 3), the magnet 76 is substantially spaced apart from the switch 80. The switch 80 senses the presence/absence of the magnet 76, and controls the operation (e.g., on or off mode) of the ice making machine 20 based at least in part upon the orientation of the ice barrier 52. Generally, the ice making machine 20 is on when the ice barrier 52 is in the first orientation, and is turned off by the switch 80 when the ice barrier 52 is in the second orientation. In some embodiments, the switch 80 includes a Hall-effect sensor to detect the presence or absence of the magnet 76. The switch 80 in the illustrated embodiment is configured to interrupt the ice-making ability of the ice making machine 20 by stopping the water flow over the ice-forming surface 40 (driven by the water pump 28) and/or by stopping the refrigeration cycle that chills the ice-forming surface 40. For this purpose, the switch 80 may be coupled to a controller (not shown) in communication with the water pump 28 and/or the refrigeration cycle.

Although a magnet and magnetic field-sensitive sensor are used to detect the orientation of the ice barrier 52 in the illustrated embodiment, any other type of position and orientation-detecting devices can instead be used as desired. By way of example only, the orientation of the ice barrier 52 can be detected by one or more optical sensors, mechanical trip switches, rotary encoders, and the like.

In operation, the ice making machine 20 produces ice pieces 38 by running water over the chilled ice-forming surface 40. Water is drawn from the water sump 32 to the top of the evaporator assembly 24 by the water pump 28. The water is discharged onto the ice-forming surface 40 from above. In other embodiments, water is supplied to the ice-forming surface 40 in other manners, such as by one or more sprayers positioned to direct water spray on the ice-forming surface 40. In any case, water supplied to the ice-forming surface 40 runs down the ice-forming surface 40 by gravity. Some of the water incident on the ice-forming surface 40 freezes before reaching the bottom. The remainder of the water incident on the ice-forming surface 40 falls onto the first portion 52C of the ice barrier 52, which directs the water toward the water sump 32 for recirculation. Ice gradually builds up on the ice-forming surface 40, forming an array of ice pieces 38, which can be connected together in a sheet or can be individually formed and separate from each other. When an ice-making cycle (starting with no ice on the ice-forming surface 40 and ending with fully-formed ice pieces 38) is complete, the ice pieces 38 are released from the ice-forming surface 40, from which they fall toward the ice barrier 52. The ice pieces 38 deflect the flexible curtain 46 away from the ice-forming surface 40 and fall onto the first portion 52C of the ice barrier 52. The weight (and in some cases, also the falling force) of the ice pieces 38 causes the ice barrier 52 to pivot about axis A toward the second orientation shown in FIG. 3, overcoming the bias of the counterweight portion 52E. Accordingly, the first portion 52C of the ice barrier 52 functions as a lever arm for moving the ice barrier 52 from the first orientation toward the second orientation.

By movement of the ice barrier 52 out of the first orientation and toward the second orientation, the ice pieces 38 are blocked from entering the water sump 32, and instead are directed into the ice chute 36. When the ice barrier 52 is in the second orientation, as shown in FIG. 3, the second portion 52F of the ice barrier 52 abuts the evaporator 48. The contact along the second portion 52F not only prevents ice pieces 38 from entering the water sump 32, but also closes a gap between the evaporator 48 and the ice barrier 52 to prevent ice pieces 38 from becoming lodged therebetween.

The ice barrier 52 can remain in the second orientation while the ice pieces 38 are discharged from the ice-forming surface 40. When the discharge of ice pieces 38 from the ice-forming surface 40 is complete, the ice barrier 52 returns to the first orientation, the flexible curtain 46 returns to the at-rest position, and a new ice-making cycle can be started. In some embodiments, the controller operates the evaporator assembly 24 in an "ice discharge mode" for a set amount of time before starting a new ice-making cycle (provided that the ice barrier 52 is in the first orientation, as sensed by the switch 80). The ice discharge mode can include stopping the refrigeration cycle, reducing the chilling effect of the refrigeration cycle, and/or reversing the flow of refrigerant in the refrigeration cycle to provide a heating effect to the evaporator 48 and the ice-forming surface 40. However, any suitable method resulting in discharge of the ice pieces 38 from the ice-forming surface 40 is acceptable.

In some embodiments, when the storage bin below the ice chute 36 becomes sufficiently full, the ice barrier 52 may not return to the first orientation from the second orientation at the end of an ice discharge event due to the piling of ice pieces 38 atop the first portion 52D. For example, in the illustrated embodiment, the switch 80 remains open (signaling to the controller that the ice chute 36 is full), and a subsequent ice-making cycle is not started. This situation can occur when the rate of production by the ice making machine 20 exceeds the removal of ice from the storage bin. Thus, the switch 80 serves to prevent overfilling of the storage bin based on the orientation of the ice barrier 52.

With continued reference to the illustrated embodiment, after an ice discharge event is completed and/or when the ice chute 36 is emptied sufficiently to release the ice barrier 52 from the second orientation (FIG. 3), the counterweight portion 52E returns the ice barrier 52 to the first orientation (FIG. 2). In order to avoid the opportunity for one or more ice pieces to become jammed in a gap between the ice barrier 52 and an adjacent surface (e.g., the adjacent evaporator assembly 24, a frame element of the ice making machine 20, or another adjacent part of the ice making machine 20), the ice barrier 52 is shaped to close the gap. In this context, jamming refers to a condition where one or more ice pieces 38 become lodged adjacent the ice barrier 52. If an ice piece 38 is lodged between the ice barrier 52 and the adjacent structure, the switch 80 in the illustrated embodiment continues to indicate "bin full" indefinitely, even as the ice chute 36 is emptied. However, based upon the shape of the ice barrier 52 in the illustrated embodiment, the potential for jamming is essentially eliminated.

More particularly, in some embodiments, the ice barrier 52 has two portions 52C, 52F that extend radially from the axis of rotation A of the ice barrier 52. The two portions 52C, 52F can be contiguous as shown in FIGS. 4 and 5, or can be separated from one another by another element or a gap. The first and second portions 52C, 52F of the ice barrier 52 are oriented with respect to one another such that when the ice barrier 52 in the second orientation, the second portion 52F of the ice barrier 52 abuts the evaporator 48 (or other adjacent structure) to prevent ice pieces 38 from being carried over into the water sump 32 or becoming lodged between the ice barrier 52 and the evaporator 48 (or other adjacent structure). When the ice barrier 52 is in the first orientation, a gap G is defined between the ice barrier 52 and the shield 44. Specifically, the gap G is a width of unoccupied space between the convoluted portion 52D and a bottom edge 88 of the flexible curtain 46 along the entire first portion 52C of the ice barrier 52. The gap G is at least as large as one of the ice pieces 38 (larger than its largest dimension if not a true cube). Therefore, even when an ice piece 38 is in a position to potentially jam the ice making machine 20 (e.g., on the ice barrier 52 when the ice barrier 52 is moving from the second orientation to the first orientation), the ice piece 38 cannot become lodged between the ice barrier 52 and the adjacent structure. The ice piece 38 falls off into the ice chute 36 before the counterweight portion 52E moves the ice barrier 52 into the first orientation. The ice piece 38 does not interrupt the normal operation of the ice making machine 20 (as a lodged ice piece 38 could by inciting a false "bin full" signal from the switch 80).

In an alternate embodiment, the ice making machine 20 includes a full-length pivotable water curtain in place of the shield 44 and flexible curtain 46. The water curtain can be similar to that shown and described in U.S. Pat. No. 6,993,929 and/or U.S. Pat. No. 6,907,744, but need not necessarily have a contoured bottom edge to direct water into the water sump 32 (as the ice barrier 52 is configured to receive the water from the ice-forming surface 40). If used, the water curtain can be configured to swing out away from the ice-forming surface 40 when ice pieces 38 are discharged, allowing the ice pieces 38 to fall toward the ice chute 36. Ice pieces 38 that fall on the ice barrier 52 can cause rotation of the ice barrier 52 from the first orientation to the second orientation.

In the second orientation, the second portion 52F of the ice barrier 52 abuts the evaporator 48 (or adjacent structure) to prevent ice pieces 38 from being carried over into the water sump 32 or becoming lodged between the ice barrier 52 and the evaporator 48 (or adjacent structure). In other embodiments, the second portion 32F need not necessarily abut the evaporator 48 or other adjacent structure, and can instead be located sufficiently close to the evaporator 48 or other adjacent structure to prevent the ice pieces from entering into a jammed position therebetween. When the ice barrier 52 is in the first orientation, a gap is defined between the ice barrier 52 and the water curtain. The gap is a width of unoccupied space between the convoluted portion 52D of the ice barrier 52 and a bottom edge of the water curtain along the entire first portion 52C of the ice barrier 52. The gap is at least as large as one of the ice pieces 38 (in its largest dimension if not a true cube). Therefore, even when an ice piece 38 is in a position to potentially jam the ice making machine 20 (e.g., on the ice barrier 52 when the ice barrier 52 is moving from the second orientation to the first orientation), the ice piece 38 cannot physically become lodged between the ice barrier 52 and the adjacent structure. The ice piece 38 falls off into the ice chute 36 before the ice barrier 52 reaches the first orientation. Thus, the normal operation of the ice making machine 20 is not easily interrupted by an ice piece 38.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. Various features and advantages of the invention are set forth in the following claims. For example, although the ice making machine 20 illustrated in FIG. 1 is shown as having two evaporator assemblies 24, various aspects of the present invention disclosed herein can be utilized in ice making machines 20 have any other number of evaporator assemblies of the same or different type.

What is claimed is:

1. An ice making apparatus comprising:

an ice-forming surface with a plurality of ice-forming locations for forming ice as liquid water is run across the ice-forming surface;

an ice collection bin positioned at a lower elevation than the ice-forming surface;

a liquid receptacle at a lower elevation than the ice-forming surface and positioned to collect liquid water from the ice-forming surface; and an ice barrier adjacent the liquid receptacle, the ice barrier movable between a first orientation in which the ice barrier is configured to direct liquid water from the ice-forming surface into the liquid receptacle, and a second orientation in which the ice barrier is configured to direct ice into the ice collection bin, wherein a portion of the ice barrier is spaced from an adjacent surface of the ice making apparatus in the first orientation to define a gap therebetween, and wherein the gap between the portion of the ice barrier and the adjacent surface is substantially closed in the second orientation.

2. The ice making apparatus of claim 1, wherein in the second orientation, the ice barrier blocks access of ice from the ice forming surface to locations in which the ice can become lodged between the ice barrier and the liquid receptacle.

3. The ice making apparatus of claim 1, wherein the ice barrier is pivotable about an axis between the first and second orientations.

4. The ice making apparatus of claim 3, wherein the ice barrier has first and second portions extending in different directions radially from the axis.

5. The ice making apparatus of claim 4, wherein the first portion is a lever arm contacted by ice falling from the ice-forming surface to pivot the ice barrier between the first and second orientations.

6. The ice making apparatus of claim 4, wherein the second portion is a wall positioned for directing liquid water from the ice-forming surface toward the receptacle in the first orientation of the ice barrier, and positioned against the adjacent surface when the ice barrier is in the second orientation.

7. The ice making apparatus of claim 1, wherein the liquid receptacle is at least partially defined by a liquid sump for recirculation of the liquid water.

8. The ice making apparatus of claim 3, wherein:

the ice barrier has a portion extending radially from the axis and defining a lever arm acted upon by ice from the ice-forming surface to pivot the ice barrier about the axis; and the portion directs ice in a direction generally away from the liquid receptacle when the ice barrier is in the second orientation.

9. The ice making apparatus of claim 8, wherein the portion of the ice barrier has a convoluted surface.

10. A barrier movable between a first orientation and a second orientation within an ice making apparatus having an ice collection bin, the barrier comprising:

a first surface for directing liquid water away from the ice collection bin when the barrier is in the first orientation, and for directing ice into the ice collection bin when the barrier is in the second orientation; and a second surface positioned with respect to the first surface to block movement of ice produced by the ice making apparatus from becoming lodged between the barrier and another portion of the ice making apparatus when the barrier is in the second orientation, wherein the barrier defines an axis about which the barrier is pivotable between the first and second orientations, the second surface extending generally upward from the axis when the barrier is in the second orientation.

11. The barrier of claim 10, wherein the first and second surfaces are contiguous.

12. The barrier of claim 10, wherein the second surface also directs liquid water away from the ice collection bin in the first orientation of the barrier.

13. The barrier of claim 10, wherein the trapped position is between the barrier and an evaporator of the ice making apparatus.

14. The barrier of claim 10, wherein:

the barrier has first and second portions extending radially from the axis; and the first portion defines a lever acted upon by falling ice produced by the ice making apparatus to pivot the barrier from the first orientation toward the second orientation.

15. The barrier of claim 14, wherein the second surface is defined by a wall of the second portion extending radially away from the axis.

16. The barrier of claim 10, wherein the first surface is defined by a convoluted wall.

17. A method of producing ice in an ice making machine, the method comprising:

running liquid water over an ice-forming surface;

chilling the ice-forming surface to freeze at least a portion of the liquid water running over the ice-forming surface;

orienting a barrier in a first orientation;

diverting a flow of liquid water received from the ice-forming surface with the barrier away from an ice collection bin in which ice produced by the ice making machine is collected;

moving the barrier to a second orientation;

deflecting the ice as the ice falls from the ice-forming surface, with the barrier, away from the ice-forming surface and toward the ice collection bin with the barrier in the second orientation; and blocking access of ice to positions in which the ice can become lodged between the barrier and an adjacent surface, the blocking occurring with the barrier in the second orientation.

18. The method of claim 17, wherein moving the barrier comprises pivoting the barrier about an axis.

19. The method of claim 17, wherein moving the barrier comprises moving the barrier with ice falling from the ice-forming surface.

20. The method of claim 17, wherein diverting the flow of liquid water and deflecting the ice as the ice falls from the ice-forming surface are performed by a common surface of the barrier.

21. The method of claim 17, further comprising recirculating the liquid water diverted by the barrier back to the ice-forming surface.

22. An ice making apparatus comprising:

an ice-forming surface with a plurality of ice-forming locations for forming ice cubes as liquid water is run across the ice-forming surface;

an ice collection bin positioned at a lower elevation than the ice-forming surface;

a liquid receptacle at a lower elevation than the ice-forming surface and positioned to collect liquid water from the ice-forming surface; and an ice barrier adjacent the liquid receptacle, the ice barrier movable between a first orientation in which liquid water from the ice-forming surface is directed into the liquid receptacle, and a second orientation in which ice from the ice-forming surface is directed into the ice collection bin, the ice barrier being configured to deflect the ice toward the ice collection bin as the ice falls from the ice-forming surface onto the barrier, the barrier blocking access of ice from the ice-forming surface to locations in which the ice can become lodged between the ice barrier and an adjacent surface.

23. The ice making apparatus of claim 22, wherein in the second orientation, the ice barrier blocks access of ice from the ice-forming surface to locations in which the ice can become lodged between the ice barrier and the liquid receptacle.

24. The ice making apparatus of claim 22, wherein the ice barrier is pivotable about an axis between the first and second orientations.

25. The ice making apparatus of claim 24, wherein the ice barrier has first and second portions extending in different directions radially from the axis.

26. The ice making apparatus of claim 25, wherein the first portion is a lever arm contacted by ice falling from the ice-forming surface to pivot the ice barrier between the first and second orientations.

27. The ice making apparatus of claim 25, wherein the second portion is a wall directing liquid water from the ice-forming surface toward the receptacle in the first orientation of the ice barrier, and blocking access of ice from the ice-forming surface to the locations when the ice barrier is in the second orientation.

28. The ice making apparatus of claim 22, wherein:

a gap exists between the ice barrier and an adjacent surface of the ice making apparatus in the first orientation of the ice barrier to permit water flow into the receptacle; and the gap is substantially closed in the second orientation of the ice barrier.

29. The ice making apparatus of claim 22, wherein the liquid receptacle is at least partially defined by a liquid sump for recirculation of the liquid water.

30. The ice making apparatus of claim 24, wherein:

the ice barrier has a portion extending radially from the axis and defining a lever arm acted upon by ice from the ice-forming surface to pivot the ice barrier about the axis; and the portion directs ice in a direction generally away from the liquid receptacle when the ice barrier is in the second orientation.

31. The ice making apparatus of claim 30, wherein the portion of the ice barrier has a convoluted surface.

* * * * *